US007097590B2

(12) United States Patent
Canali

(10) Patent No.: US 7,097,590 B2
(45) Date of Patent: Aug. 29, 2006

(54) GYM EQUIPMENT, PARTICULARLY FOR THE TRAINING OF MOVEMENTS ON THE HIGH BAR

(76) Inventor: Vincenzo Canali, Via Carpaneto, 78, 43028 Tizzano Val Parma (IT)

( * ) Notice: Subject to any disclaimer, the term of this patent is extended or adjusted under 35 U.S.C. 154(b) by 11 days.

(21) Appl. No.: 11/076,880

(22) Filed: Mar. 11, 2005

(65) Prior Publication Data

US 2005/0239605 A1 Oct. 27, 2005

(30) Foreign Application Priority Data

Mar. 11, 2004 (IT) ..... PR2004A0019

(51) Int. Cl.
*A63B 7/02* (2006.01)

(52) U.S. Cl. ..... 482/24; 482/23; 482/38

(58) Field of Classification Search ..... 482/23, 482/24, 33, 34, 38, 95, 96, 110, 35–37, 77, 482/143–4; 472/118, 120–4, 80, 135
See application file for complete search history.

(56) References Cited

U.S. PATENT DOCUMENTS 402,495 A * 4/1889 Vaidis ..... 482/24
567,543 A * 9/1896 Kinemann et al. ..... 482/24
2,062,813 A * 12/1936 Knourek ..... 482/38
2,123,233 A * 7/1938 Crawford ..... 482/24
4,377,281 A * 3/1983 Jesernig et al. ..... 482/96
4,431,184 A * 2/1984 Lew et al. ..... 482/43
6,651,273 B1 * 11/2003 Vilsmeier ..... 5/11

* cited by examiner

*Primary Examiner*—Stephen R. Crow
*Assistant Examiner*—Allana Lewin
(74) *Attorney, Agent, or Firm*—Modiano & Associati; Albert Josif; Daniel J. O'Byrne

(57) ABSTRACT

A piece of gym equipment, particularly for training for the execution of exercises to be performed on the high bar, comprising a tubular element, which is adapted to be supported, so that it can rotate about its own axis, by a supporting frame so that it is parallel to the ground, a carriage being able to slide vertically with respect to the tubular element and being rigidly coupled thereto, in order to oscillate with the tubular element about its axis, the carriage having a seat to allow seating of an athlete, counterweight elements being provided in order to contrast a downward motion of the carriage away from the tubular element and to facilitate an upward movement of the carriage toward the tubular element.

10 Claims, 3 Drawing Sheets

GYM EQUIPMENT, PARTICULARLY FOR THE TRAINING OF MOVEMENTS ON THE HIGH BAR

The present invention relates to a piece of gym equipment, particularly for training movements on the high bar. More particularly, the invention relates to a piece of gym equipment that allows the athlete to perform a preparatory movement for training to perform the same movement on the high bar normally used in men and women artistic gymnastics.

The piece of gym equipment according to the invention is further suitable in general for training the athlete to perform movements in a hanging position, providing the athlete at all times with the perception of the position of his body with respect to the piece of equipment.

BACKGROUND OF THE INVENTION

As is known, the high bar is one of the most complicated pieces of gymnastic apparatus as regards the athlete's learning of the movements for performing exercises with this piece of apparatus.

Generally, one of the most difficult movements to teach to young athletes or to athletes who otherwise approach the high bar for the first time is the movement that allows the athlete to pass from the hanging position, i.e., the position in which the athlete hangs from the bar with his arms, to a position in which the athlete hangs over the bar, i.e., in which his arms rest on the bar and therefore the body is raised from the ground and the pelvis is in contact with the bar.

In order to pass from the hanging position to a position in which the athlete rests on the bar, raised from the ground, it is necessary to perform an oscillation, while hanging from the bar, and then perform a movement for gathering the legs and drawing them up in order to perform a sort of whiplash movement, which allows the body of the athlete to pass from the position below the bar to a position above the bar.

This movement is not at all easy to learn, and especially in youngsters in the learning step this can cause some fear for the risk of falls and the like.

SUMMARY OF THE INVENTION

The aim of the present invention is to provide a piece of gym equipment, particularly for training for the execution of movements to be performed on the high bar, which allows to train the athlete to perform the movement for passing from a hanging position to a position in which he rests on the bar.

Within this aim, an object of the present invention is to provide a piece of gym equipment, particularly for training for the execution of movements on the high bar, which allows the athlete to perform the step of swinging while hanging from the bar and of gathering his legs in order to move them toward the bar and thus be assisted in reaching the position in which he rests on the bar.

Another object of the present invention is to provide a piece of gym equipment, particularly for training for the execution of movements on the high bar, which allows the athlete to determine the degree of assistance that the piece of gym equipment can provide in training for the movement described above.

Within this aim, an object of the present invention is to provide a piece of gym equipment that is highly reliable, relatively simple to provide and at competitive costs.

This aim and these and other objects that will become better apparent hereinafter are achieved by a piece of gym equipment, particularly for training for the execution of exercises to be performed on the high bar, characterized in that it comprises a tubular element, which is adapted to be supported, so that it can rotate about its own axis, by a supporting frame so that it is parallel to the ground, a carriage being able to slide vertically with respect to said tubular element and being rigidly coupled thereto, in order to oscillate with said tubular element about its axis, said carriage having a seat to allow seating of an athlete, counterweight means being provided in order to contrast a downward motion of said carriage away from said tubular element and to facilitate an upward movement of said carriage toward said tubular element.

BRIEF DESCRIPTION OF THE DRAWINGS

Further characteristics and advantages of the invention will become better apparent from the description of a preferred but not exclusive embodiment of the piece of gym equipment according to the present invention, illustrated by way of non-limiting example in the accompanying drawings, wherein.

DESCRIPTION OF THE PREFERRED EMBODIMENTS

Figure 1:
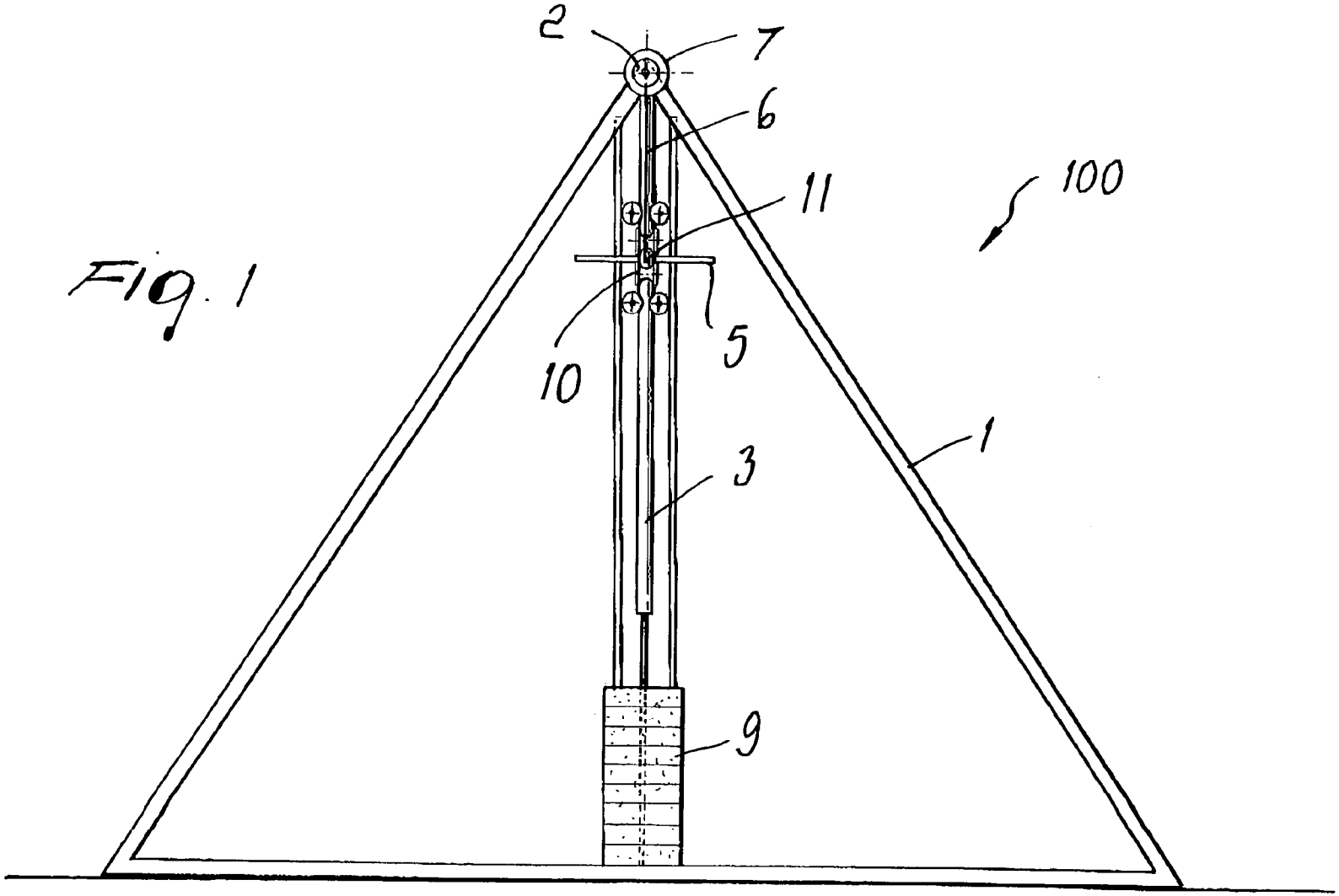
FIG. 1 is a side elevation view of the piece of gym equipment according to the present invention in a first working configuration.

With reference to the figures, the piece of gym equipment according to the present invention, generally designated by the reference numeral 100, comprises a tubular element 2, which is supported by a supporting frame 1 so that the tubular element 2 is arranged at a certain height from the ground and parallel thereto and can rotate, for example within bushes 7 provided at the posts of the frame 1.

Conveniently, the supporting frame can be provided by two pairs of posts arranged respectively so as to form a triangular configuration, or for example the frame can be constituted by just two vertical posts, to each of which two braces, adapted to be fixed to the ground, are connected. The supporting frame may of course have any shape, so long as it is adapted to support the tubular element 1 so that it is parallel to the ground at a certain height thereof.

Substantially, the tubular element 2 or bar is inserted in the bushes 7 so that it is perpendicular to the posts 1 and can rotate about its diametrical axis within the bushes 7.

A second pair of rod-like tubular elements 3, arranged parallel to each other, is connected to the bar 2 and is rigidly coupled thereto.

The lower ends of the tubular elements 3 are connected to each other by a transverse element 4, so as to form a quadrilateral together with the bar or tubular element 2.

Two mutually opposite carriages 10 can slide along the pair of tubular elements 3 and are connected by means of two pins 11 arranged at the end of a supporting seat 5 on which the athlete is placed. The seat can preferably rotate about the axis of the pins 11.

Substantially, the two mutually opposite carriages 10 slide along the tubular elements 3, with the seat 5 rigidly coupled thereto, and therefore said seat also slides along the tubular elements 3.

Sliding of the carriages 10 along the tubular elements 3 is facilitated by the presence of counterweight means, constituted for example by a pack of weights 9 or another similar element that is adapted to provide a force in opposition to the downward action of the seat 5 along the tubular elements 3.

Such counterweight means are conveniently connected, for example by means of cables 6 and pulleys 8, to the ends of the pivots 11 to which the supporting seat 5 is fixed.

Substantially, therefore, when the athlete sits on the seat 5, his weight causes the seat 5 to descend along the tubular elements 3, thus causing the carriages 10 to slide downwardly. At the same time, the counterweight means 9 rise along the cables 6, balancing the downward motion of the athlete.

The oscillating movement that the athlete can perform while sitting on the seat 5, similar to the movement performed on a swing but in this case with the athlete holding the bar 2 with his hands, triggers a forward oscillation, and during the corresponding return oscillation the counterweight means 9 assist the athlete in making the carriages 10 rise together with the seat 5, combining the action with a rotation about the transverse axis, caused by the return oscillation of the tubular elements 3 with the associated carriages 10 and seat 5.

With the combination of the circular, i.e., oscillating, action and of the thrust received by the kinetic action of the counterweight means 9 on the carriages 10 and on the seat 5 rigidly coupled thereto, and by means of appropriate muscle actions, the resulting effect is that the carriage repositions itself in an upward region despite the weight of the athlete and the athlete moves beyond the horizontal line of the bar 2 and thus rises to the resting position, upright on his arms, on the bar 2.

The intensity of the exercise can be graduated depending on the chosen counterweight means, i.e., depending on the amount of weight that is selected, and also according to the breadth of the oscillation that the athlete wishes to perform while sitting on the seat 5 and holding the bar 2.

Therefore, the piece of gymnastic equipment according to the present invention allows to perform a movement while hanging from the bar 2 but with the athlete sitting on the seat 5. FIG. 1 illustrates the initial position, in which the athlete has not yet sat on the seat 5, or the final position, in which the seat 5 has returned upwardly following the descent of the counterweight means 9.

Figure 2:
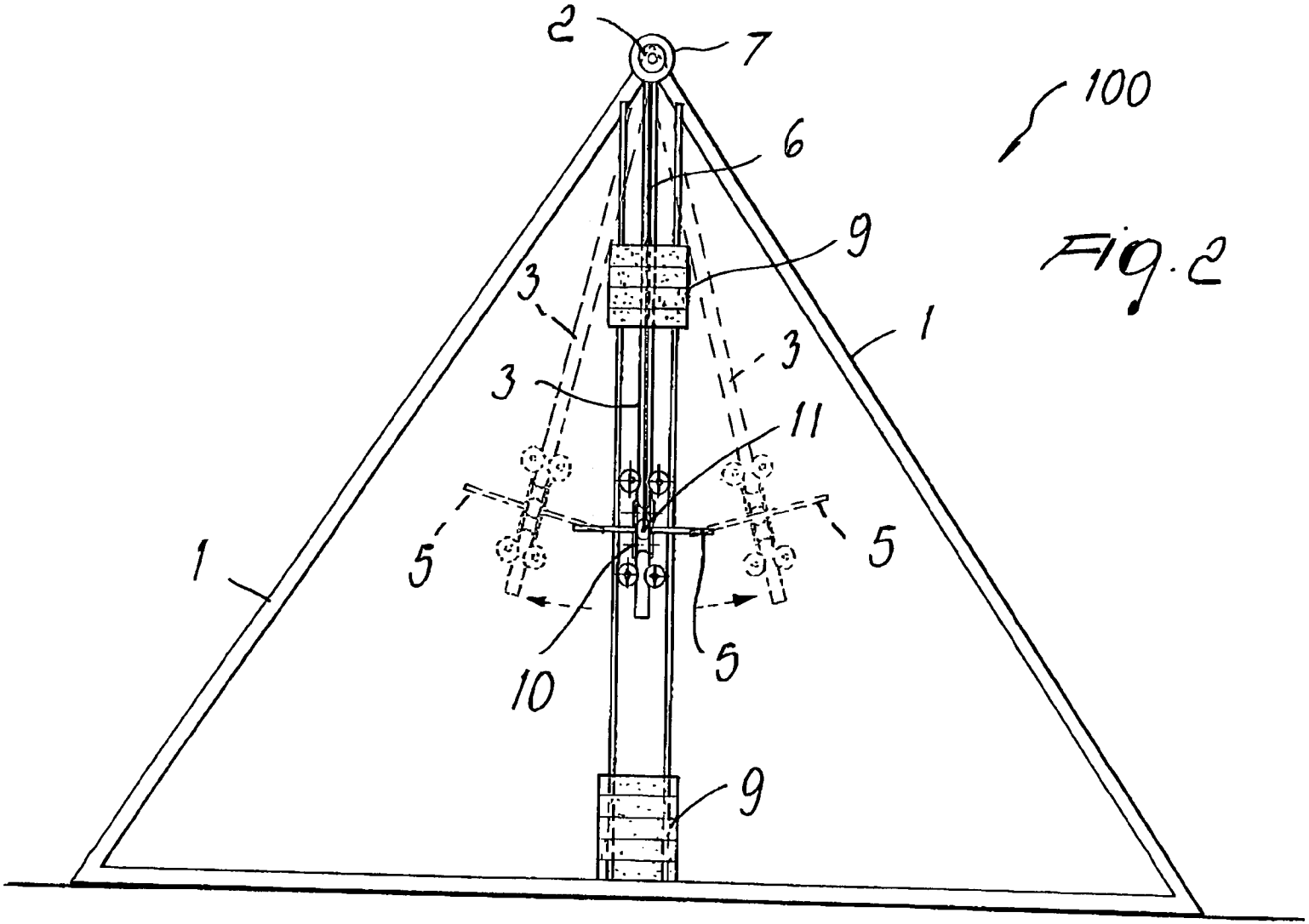
FIG. 2 is a side elevation view of the gym equipment of FIG. 1, shown in a second working configuration.
Figure 3:
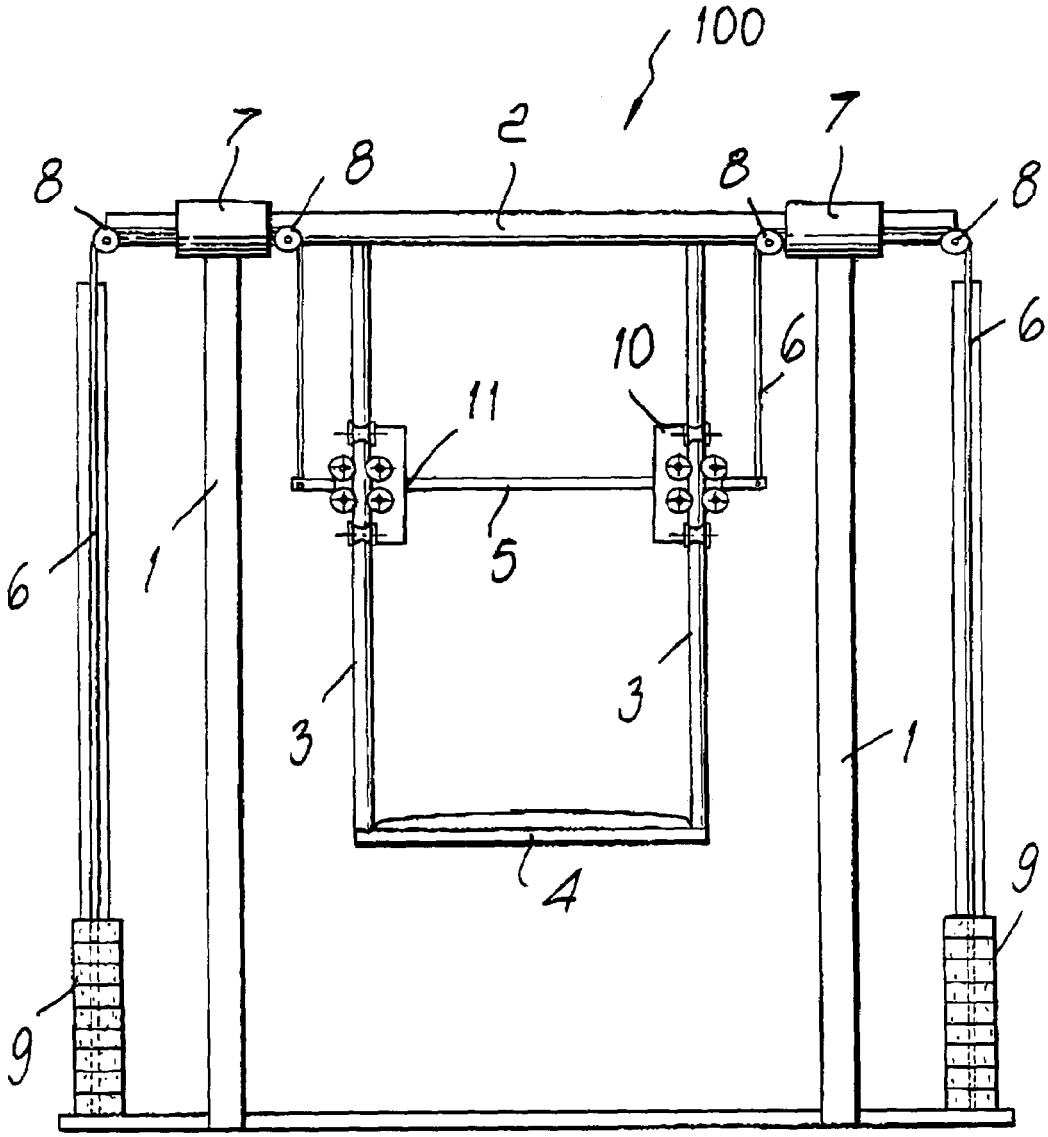
FIG. 3 is a front elevation view of the piece of gym equipment according to the present invention.

FIG. 2 instead illustrates the case in which the athlete is sitting on the seat 5 and is in the lowest position of the oscillation, i.e., when the counterweight means 9 are in the highest possible position.

The piece of gymnastic equipment according to the invention therefore allows a user to practice the movement in order to move from the hanging position to the supported position, upright on his arms, resting on the bar 2.

The piece of gymnastic equipment thus conceived is susceptible of numerous modifications and variations, all of which are within the scope of the inventive concept; all the details may further be replaced with other technically equivalent elements.

In practice, the materials used, as well as the contingent shapes and dimensions, may be any according to requirements and to the state of the art.

The disclosures in Italian Patent Application no. PR2004A000019, from which this application claims priority, are incorporated herein by reference.

What is claimed is:

1. A piece of gym equipment, particularly for training for the execution of exercises to be performed on the high bar, comprising a tubular element, which is adapted to be supported, so that it can rotate about its own axis, by a supporting frame so that it is parallel to the ground, a carriage being able to slide vertically with respect to said tubular element and being rigidly coupled thereto, in order to oscillate with said tubular element about its axis, said carriage having a seat to allow seating of an athlete, counterweight means being provided in order to contrast a downward motion of said carriage away from said tubular element and to facilitate an upward movement of said carriage toward said tubular element.

2. The piece of gymnastic equipment according to claim 1, wherein said tubular element rotates in bushes arranged at an upper end of posts of said supporting frame.

3. The piece of gymnastic equipment according to claim 1, wherein said carriage comprises two mutually opposite carriages that are connected to each other by means of said seat and can move along two tubular elements, which are arranged at right angles to said tubular element and are joined to each other at their lower ends by a transverse connecting element.

4. The piece of gymnastic equipment according to claim 3, wherein said vertical tubular elements and said transverse connecting element are rigidly coupled to said horizontal tubular element and form a quadrilateral with it.

5. The piece of gymnastic equipment according to claim 3, wherein said supporting seat is connected to said carriages by means of two pins that protrude therefrom.

6. The piece of gymnastic equipment according to claim 5, wherein said counterweight means are connected to the ends of said pins for connecting the supporting seat to said carriages.

7. The piece of gymnastic equipment according to claim 5, wherein said counterweight means are connected to the respective ends of said pins for connecting said supporting seat to said carriages.

8. The piece of gymnastic equipment according to claim 5, wherein each one of said counterweight means comprises a pack of weights, which is connected by means of a cable and pulleys to the respective end of said pins for connecting said supporting seat to said carriages.

9. The piece of gymnastic equipment according to claim 1, wherein the action applied by said counterweight means can be adjusted according to the selected amount of counterweight means.

10. The piece of gymnastic equipment according to claim 5, wherein said supporting seat can rotate about an axis of the pins connected thereto.

* * * * *